US005768879A

United States Patent [19]

Stahlecker

[11] Patent Number: 5,768,879

[45] Date of Patent: Jun. 23, 1998

[54] OPEN-END SPINNING PROCESS AND APPARATUS FOR PERFORMING SAME

[75] Inventor: Fritz Stahlecker, Josef-Neidhart-Strasse 18, 73337 Bad Überkingen, Germany

[73] Assignees: Fritz Stahlecker, Bad Überkingen; Hans Stahlecker, Süssen, both of Germany

[21] Appl. No.: 775,395

[22] Filed: Dec. 31, 1996

[30] Foreign Application Priority Data

Jan. 20, 1996 [DE] Germany ..... 196 01 958.3

[51] Int. Cl.[6] ..... D01H 4/00

[52] U.S. Cl. ..... 57/401; 57/403

[58] Field of Search ..... 57/401, 403, 408, 57/411–413, 328, 333; 19/150

[56] References Cited

U.S. PATENT DOCUMENTS

| | | | |
|---|---|---|---|
| 4,237,685 | 12/1980 | Pelagio et al. | 19/150 X |
| 4,672,800 | 6/1987 | Fehrer | 57/401 X |
| 4,676,062 | 6/1987 | Brockmanns et al. | 57/401 X |
| 4,697,411 | 10/1987 | Artzt et al. | 57/401 |
| 4,718,227 | 1/1988 | Handschuch | 57/401 |
| 4,745,738 | 5/1988 | Stahlecker | 57/401 X |

FOREIGN PATENT DOCUMENTS

| | | |
|---|---|---|
| 0 236 324 B1 | 9/1987 | European Pat. Off. . |
| 4040102 | 6/1992 | Germany . |

*Primary Examiner*—C. D. Crowder
*Assistant Examiner*—Tina R. Taylor
*Attorney, Agent, or Firm*—Evenson McKeown Edwards & Lenahan, PLLC

[57] ABSTRACT

In a process in open-end spinning at least one sliver is opened into single fibers. A transfer surface, rotating at a higher speed than the opened single fibers, takes up same already in the opening area. The single fibers are taken along transversely to the rotational direction in the form of an expanded fiber veil. Before completion of one revolution of the transfer surface, the single fibers are transferred to a yarn forming line of a twist device, which, for example, comprises a friction roller pair, and are withdrawn, under the action of an imparted twist, along the yarn forming line thus forming a yarn. The yarn withdrawal takes place hereby transversely to the rotational direction of the transfer surface. The withdrawal speed corresponds at least to the speed of the single fibers as they arrive at the yarn forming line.

6 Claims, 2 Drawing Sheets

OPEN-END SPINNING PROCESS AND APPARATUS FOR PERFORMING SAME

BACKGROUND AND SUMMARY OF THE INVENTION

The present invention relates to a process in open-end spinning in which fed fiber material in sliver form is opened, the single fibers being taken up by a rotating transfer surface and being transferred before completion of one revolution of the transfer surface to a yarn forming line of a twist device, from which the single fibers are withdrawn in the form of a yarn at a speed which at least equals the rotational speed of the transfer surface. The present invention relates further to a device for carrying out the process.

In the case of a process and a device of this type (U.S. Pat. No. 4,718,227) the transfer surface is constructed as a narrow groove in the peripheral surface of a transfer roller, whose circumferential speed is significantly lower than the speed of the single fibers arriving at the transfer roller. Thus bundling of the opened fibers and a doubling is assumed to take place in a twist-free zone before twist formation. The yarn is transferred tangentially in a transport direction from the transfer roller to the yarn forming line of a twist device.

Bundling and doubling on the transfer roller results in the opened single fibers being slowed down and therefore crinkled. This crinkling can only be insufficiently alleviated by the withdrawal speed being higher than the rotational speed of the transfer roller.

It is an object of the present invention to improve the quality of the spun yarn in a process of the above-mentioned type in that the fibers are never slowed down at any point along their path from fiber material to yarn, and that, due to the omission of doubling which takes place in the known process, any possible drafting errors occurring during opening of the fiber material are alleviated in other ways.

This object has been achieved in accordance with the present invention in that the rotational speed of the transfer surface is at least equal to the speed of the fiber as they are taken up by the transfer surface, and in that the single fibers are taken up in the form of a fiber veil, expanded transversely to the rotation direction, and in that the yarn forming line extends transversely to the rotational direction of the transfer surface.

Due to the rotational speed of the transfer roller being at least as high as the speed of the opened single fibers, and the withdrawal speed being at least equal to that of the arrival speed of the opened single fibers at the yarn forming line, the single fibers are never slowed down during the entire spinning process, but are rather ideally continuously accelerated. The single fibers thus remain constantly stretched, which has an advantageous effect on the quality of the spun yarn. Due to the formation of a fiber veil expanded transversely to the rotational direction of the transfer surface, a lateral open fiber formation arises, which contains as many or even more fibers than the spun yarn. In conjunction with the yarn forming line which extends transversely to the rotational direction of the transfer surface, this results in an axial staggering of the single fibers during spinning in, whereby any possible drafting errors which may have arisen during opening of the fiber material are lessened. The axial staggering during spinning leads to a somewhat stronger twist in the core of the yarn and to a somewhat softer twist on the outside of the yarn. Both twists can, however, be predetermined due to the fact that the extent of the axial staggering can be set beforehand.

The separate transfer roller, independent of the yarn forming line, takes no part in the twist formation and is therefore driven at a speed which is practical for the feeding of the fiber veil to the yarn forming line. The controlled transportation of the opened single fibers and the twist formation are two separate functions. Thus it is possible to adapt the relevant fiber guiding surface at the transfer roller and at the twist device to the relevant function.

The single fibers are advantageously taken up directly after opening of the fiber material by the transfer roller. This prevents the single fibers being accelerated to such a high speed after opening that the even higher withdrawal speed is then no longer controllable.

Advantageously the single fibers of a plurality of slivers are fed to the yarn forming line. Thus not only coarser yarns can be spun, but also a greater axial staggering arises in the yarn forming line, whereby any possible unevenness in the yarn is further reduced. It is thereby possible to feed slivers of varying sizes, and should it be required, to leave a slight space between two fed slivers. In this way, different fibers can be spun into the core and the outside of a yarn.

In the device for carrying out the process, a transfer roller is provided which is arranged parallel to the axis of the opening roller and which rotates in the opposite direction thereto, the circumferential surface of said transfer roller taking the form of a transfer surface and extending right up to the opening area. The end of the fiber beard can thereby, if required, already be in contact with the circumferential surface of the transfer roller, so that the single fibers are transported at a controlled speed directly after they have been opened.

The transport roller is advantageously provided with an air-permeable peripheral surface, which is suctioned from the opening area to a transfer area where the single fibers are transferred to the twist device. Thus the single fibers gain the circumferential speed of the transfer roller practically slip-free. The degree of hold on the transfer surface can be set by the amount of suction.

In one embodiment of the present invention, the twist device comprises a friction roller pair, which is arranged parallel to the axis of the transfer roller. Through friction spinning, such friction rollers, in various forms, are prior art. The wedge shaped gap of the friction roller pair defines thereby the yarn forming line and the yarn withdrawal direction. A further twist device can be provided in that an air nozzle is arranged downstream of the friction roller pair, which air nozzle sets the final twist of the spun yarn. The arrangement of the intensities of the friction rollers and the air nozzle arranged downstream thereof can be used, with respect to twist formation, to spin different types of yarn.

It can be provided that the friction rollers just impart the single fibers a pre-twist in a consolidation phase, while the actual twist formation is effected by the air nozzle arranged downstream. Alternatively, the friction rollers can impart the essential twist to the yarn, while the air nozzle merely plays an auxiliary role in the twist formation. The air nozzle can, however, just be used to subsequently treat the finished yarn already twisted by the friction roller pair, so that the bulk of the yarn is increased.

Practically, the width of the opening roller and the width of the transfer roller is designed for a plurality of adjacent slivers. This results not only in a greater staggering of the single fibers in the yarn forming line, but also permits variation in the yarn fineness.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
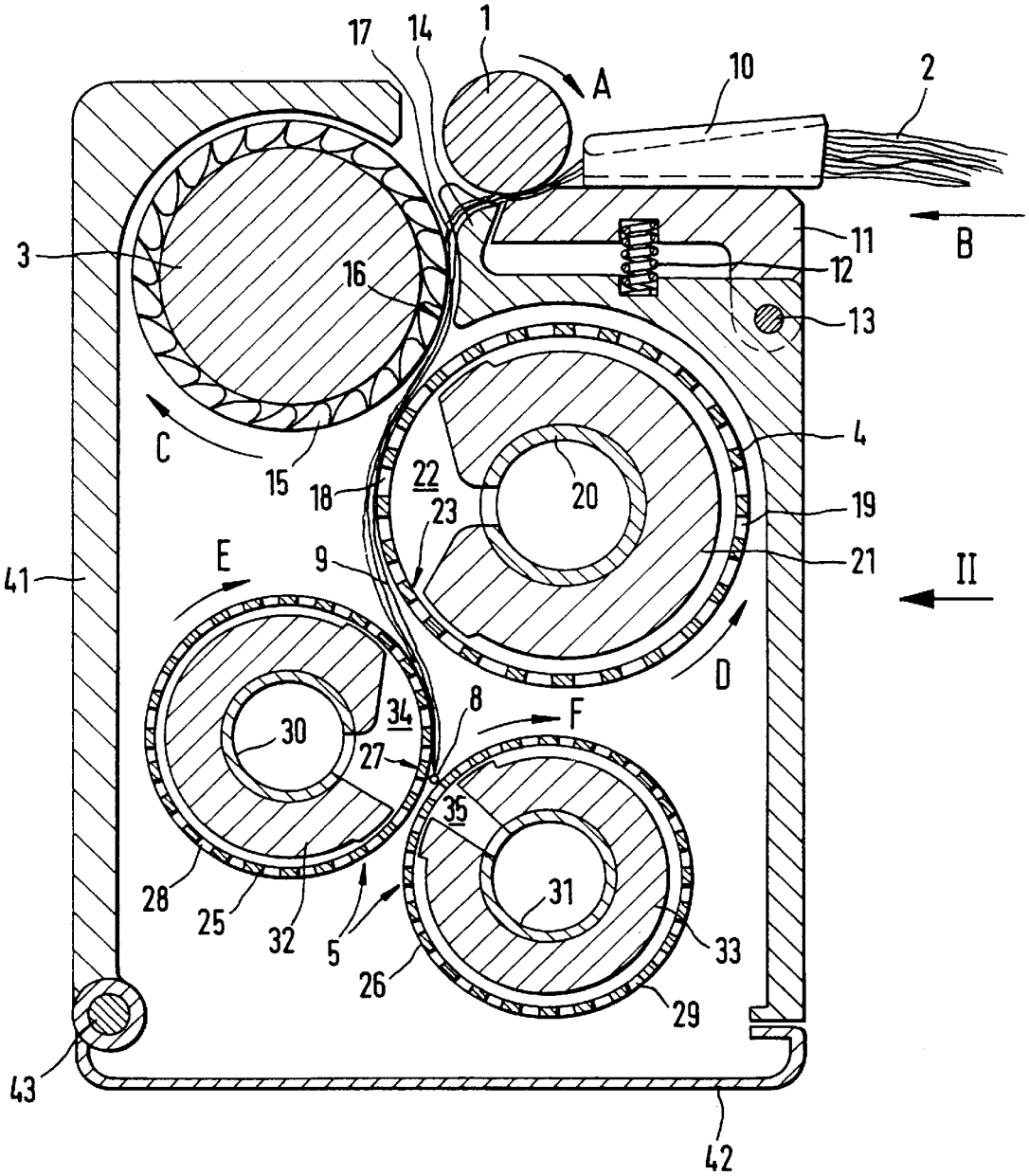
FIG. 1 is a schematic sectional side view of a device constructed according to a preferred embodiment of the present invention comprising an opening roller, a transfer roller and a friction roller pair.
Figure 2:
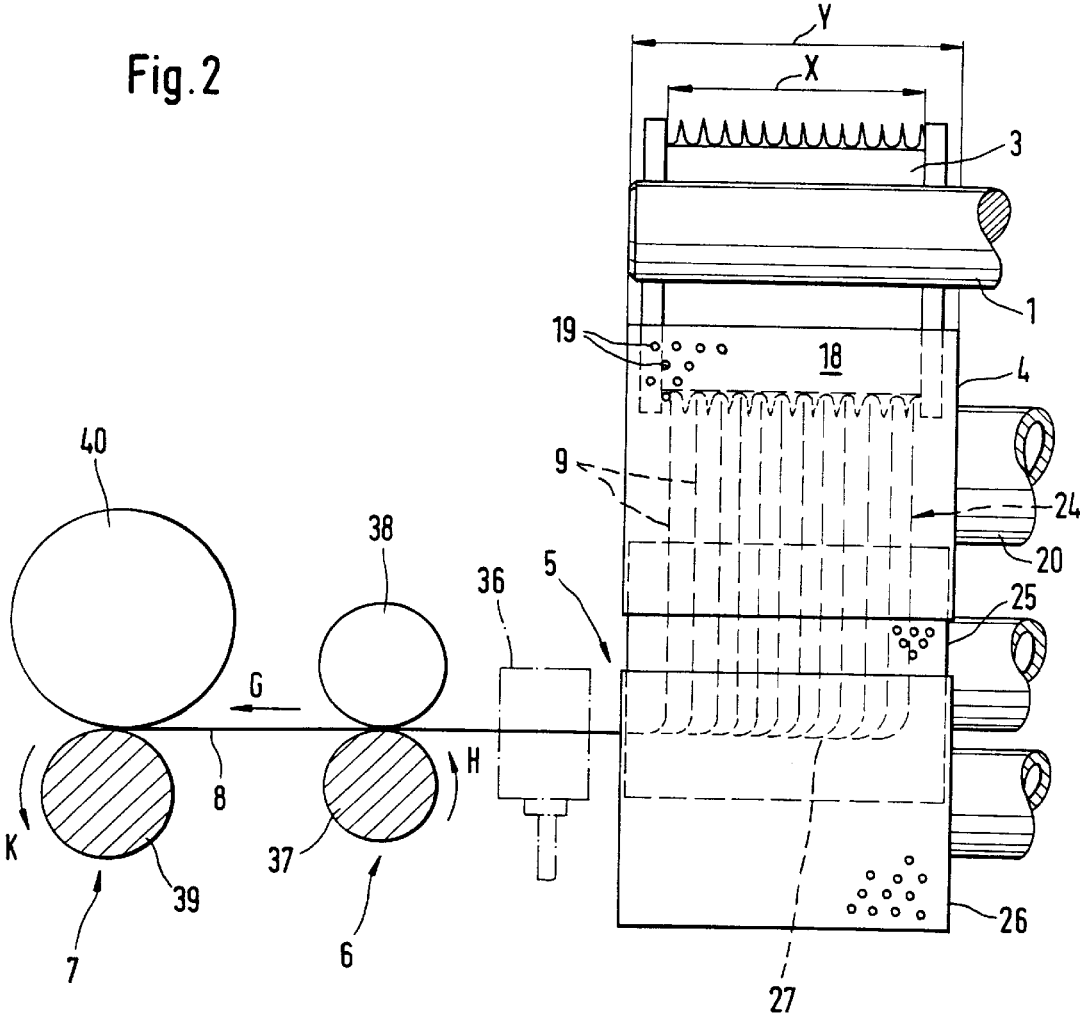
FIG. 2 is a view in the direct-on of arrow II of FIG. 1, whereby some components have been omitted and whereby a withdrawal and winding device are additionally shown.

The open-end spinning device according to FIGS. 1 and 2 comprises as its essential components a feed roller 1 for a plurality of adjacent slivers 2, an opening roller 3, a transfer roller 4, a twist device 5, a withdrawal device 6 and a winding device 7.

The slivers 2 are to be spun to a yarn 8 in such a way that the single fibers 9 are at no point slowed down, but rather ideally continuously accelerated. The speeds between the feed roller 1, the opening roller 3, the transfer roller 4 and the withdrawal device 6 are all accordingly set in a way to be described below.

The wide feed roller 1, driven in rotational direction A, serves to feed a plurality of slivers 2 in feed direction B. The slivers 2 are guided into the nipping gap between the feed roller 1 and a feed table 11 by a feed condenser 10 in a known way. The feed table 11 is pressed against the feed roller 1 by a spring 12 and is pivotable around a stationary swivel axle 13. During operation, the feed condenser 10 rests on the feed table 11 from above. A stationary fiber beard support 14 is provided between the feed roller 1 and the opening roller 3, which fiber beard support 14 comprises lateral guides for the very wide fiber beard 17 to be combed. The rotational direction C of the opening roller 3 corresponds to the rotational direction A of the feed roller 1, but the opening roller 3 rotates, however, at a much higher speed. The fitting 15 of the opening roller 3 combs the fiber beard 17 in an opening area 16 into single fibers 9.

The transfer roller 4 is arranged in close proximity, and parallel to the axis of the opening roller 3. The circumferential direction D of the transfer roller 4 runs in the opposite direction of the rotational direction C of the opening roller 3. The peripheral surface of the transfer roller 4 takes the form of a transfer surface 18 for taking up the opened single fibers 9. This transfer surface 18 is arranged in direct proximity to the opening area 16. Thus the end of the fiber beard 17 may be in contact with the transfer surface 18.

In order that the single fibers 9 are held on the transfer surface 18 and transported by it, the peripheral surface of the transfer roller 4 is provided with a perforation 19, as is known in friction spinning. There is a suction pipe 20 located inside the transfer roller 4, on which suction pipe 20 the transfer roller 4 is supported in a way not shown. The suction pipe 20 carries a sealing insert 21, which leaves a suction opening 22 free, which extends approximately from the opening area 16 to a transfer area 23, at which the single fibers 9 leave the transfer surface 18 again.

Because the single fibers 9 reach the transfer surface 18 already in the opening area 16, they are prevented from being accelerated by the opening roller 3 too much.

When the single fibers 9 are transferred to the transfer surface 18 a fiber veil 24 is formed, which expands transversely to the rotational direction D of the transfer roller 4. The transfer surface 18 rotates hereby at a somewhat higher speed than the speed of the single fibers 9 as they are taken up by the transfer roller 4.

Long before the transfer surface 18 of the transfer roller 4 has completed one revolution, the single fibers 9 reach the transfer area 23, from where they are transferred over to a first friction roller 25. The friction roller 25 takes up the single fibers 9 on its suctioned surface and transports them in arrow direction E to a yarn forming line 27, which is formed by the wedge-shaped gap of the friction roller 25 with a closely adjacent second friction roller 26. The suctioned surfaces of the two friction rollers 25 and 26 do not come into contact with each other. The friction roller 26 is driven in arrow direction F and thus runs in the same direction as the driven friction roller 25.

The single fibers 9 transported to the yarn forming line 27 are withdrawn along this yarn forming line 27 at a speed which is at least equal to the arrival speed of the single fibers 9 at the yarn building line 27.

Because the single fibers 9 are disposed on the transfer surface 18 in the form of a fiber veil 24, an axial staggering occurs when the single fibers 9 are spun along the yarn forming line 27, which reduces any possible drafting errors which occurred during the opening process. This reduction of error is greater the more slivers 2 are used.

The peripheral surfaces of the friction rollers 25 and 26 are also each provided with a perforation 28 or 29. Each friction roller 25,26 is supported on a suction pipe 30,31, on which in the inside of the relevant friction roller 25,26 a sealing inserted 32,33 is provided, which leaves an open suction slit 34 or 35, directed against the yarn forming line 27.

As shown in FIG. 2 with a dot-dash line, an air nozzle 36 can be arranged downstream of the friction roller pair 25,26 for the purpose of twist formation. In conjunction with the intensities of the friction rollers 25,26 with the air nozzle 36, different intensities of twist are possible. It can be determined beforehand whether the greater part of the twist formation takes place already in the wedge-shaped gap of the friction rollers 25,26, or later by means of the air nozzle 36.

The separate functions of the transfer roller 4 and the friction rollers 25,26 and the air nozzle 36 permit the surface of the transfer roller 4 and the friction rollers 25,26 to adapted ideally to the given conditions. This applies for example to the size and structure of the hole pattern or the surface structure by means of a possible coating.

The formed yarn 8 is withdrawn in yarn withdrawal direction G along the yarn forming line 27 by means of the withdrawal device 6. This comprises a bottom cylinder 37 driven in arrow direction H, on which a press roller 38 is disposed. A winding device 7 is arranged downstream from the withdrawal device 6, which winding device 7 comprises a winder roller 39 driven in rotational direction K and a yarn traversing device (not shown). The package 40 held in package holders (not shown) is disposed on the winding roller 39.

The sealing insert 21 in the inside of the transfer roller 4 is adjustable in such a way that the suction opening 22 can be adjusted to different stapel lengths. Whether the transported single fibers 9 leave the transfer roller 4 at the transfer area 23 sooner or later is something that can also be set here.

The above mentioned components are arranged in a housing 41, which is provided with a cover 42, which can swivelled around an axle 43 for maintenance purposes.

As can be seen from FIG. 2, the width Y of the transfer roller 4 is larger than the width X of the opening roller 3. The slivers 2 should be guided as closely together as possible before they reach the nipping line at the feed roller 1, so that they can be opened easily into single fibers 9.

An open-ended sliver 2 can not only be achieved by the high draft of the opening roller 3, but also a sufficiently wide fiber veil 24 is formed. This is the so-called lateral opening, whereby the number of fibers in the width is approximately the same as the number of fibers in the cross section of the subsequently formed yarn 8. Only at the yarn forming line 27 are tee single fibers 9 of the fiber veil 24 guided together in a yarn like formation, with however a definite staggering in fiber withdrawal direction G. Those fibers 9, which appear in the area of the yarn tip, are inevitably more twisted than those single fibers 9 which subsequently appear—in yarn withdrawal direction G—on the half-finished yarn. The yarn 8 is therefore twisted differently in its core and on the outside, whereby these differences can be predetermined by the width X of the opening roller 3.

The following is an example with reference to the speed ratios:

It is supposed, that the feed roller 1 feeds the slivers 2 at a speed of approximately 0.8 m per minute. It is further supposed, that the single fibers 9, which have just left the fiber beard 17, have a speed of 8 m per second. The transfer roller 4 should have a rotational speed of approximately 9 m per second. It is at this speed that the single fibers 9 arrive at the yarn forming line 27. From there they are advantageously withdrawn at a withdrawal speed of approximately 11 m per second. This corresponds to a delivery of the spun yarn 8 of 660 m per minute.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of making yarn using an open end spinning process comprising:

opening at least one fiber sliver to single fibers in an opening area with formation of a fiber beard from which individual fibers are released and transported in a transport direction, taking up said fibers by a collecting surface immediately after leaving the fiber beard and while travelling at a relatively low speed, moving the collecting surface at a higher speed than the speed of the arriving fibers with formation of a fiber veil expanded transversely to a fiber transport direction of said collecting surface whereby said fibers extend essentially parallel to each other, and withdrawing said fiber veil from the collecting surface at a speed at least corresponding to the speed of the fibers leaving the fiber beard and arriving at the collecting surface, wherein the fiber veil is removed from the collecting surface and after leaving the collecting surface is bundled to form a fiber bundle which is then pulled off with a spinning rotation being conferred on it to impart a spinning twist to form a yarn while the fiber bundle is being pulled off.

2. The method according to claim 1, wherein said collecting surface is provided internally with a suction device whose suction opening faces said opening area.

3. The method according to claim 2, wherein said opening area is defined by an opening roll having opening fixtures on its circumference, said suction opening of the suction device of the collecting surface facing the circumference of the opening roll.

4. An apparatus for open end spinning of yarn comprising:

an opener for opening at least one fiber sliver to single fibers in an opening area thereby forming a fiber beard from which individual fibers are released and transported in a transport direction while traveling at a relatively low speed, a collecting surface disposed immediately adjacent the opening area for taking up said fibers immediately after leaving the fiber beard, wherein the collecting surface is moving at a higher speed than the speed of the arriving fibers with formation of a fiber veil expanded transversely to a fiber transport direction of said collecting surface whereby said fibers extend essentially parallel to each other, and a withdrawal device for withdrawing said fiber veil from the collecting surface at a speed at least corresponding to the speed of the fibers leaving the fiber beard and arriving at the collecting surface, wherein the fiber veil is removed from the collecting surface and after leaving the collecting surface is bundled to form a fiber bundle which is then pulled off with a spinning rotation being conferred on it to impart a spinning twist to form a yarn while the fiber bundle is being pulled off.

5. The apparatus according to claim 4, wherein said collecting surface is provided internally with a suction device whose suction opening faces said opening area.

6. The apparatus according to claim 5, wherein said opening area is defined by an opening roll having opening fixtures on its circumference, said suction opening of the suction device of the collecting surface facing the circumference of the opening roll.

* * * * *